United States Patent [19]

Phan

[11] 4,044,449

[45] Aug. 30, 1977

[54] METHOD OF MAKING REFRIGERATING UNITS AND THE LIKE AND PRODUCT THEREOF

[75] Inventor: Chi Quy Phan, Paris, France

[73] Assignee: Thomson-Brandt, Paris, France

[21] Appl. No.: 547,953

[22] Filed: Feb. 7, 1975

[51] Int. Cl.[2] ..... B23P 3/00; B23P 19/04; B29D 27/04

[52] U.S. Cl. ..... 29/460; 29/469; 52/309.8; 264/46.5; 264/46.7; 264/261; 312/214

[58] Field of Search ..... 264/46.5, 253, 261; 312/214; 29/428, 469, 460; 52/592, 309, 535, 406

[56] References Cited

U.S. PATENT DOCUMENTS

| | | | |
|---|---|---|---|
| 70,030 | 10/1967 | Scanlan | 52/535 |
| 552,939 | 1/1896 | Wahl et al. | 52/592 |
| 1,507,032 | 9/1924 | Schmitz | 312/214 X |
| 1,971,010 | 8/1934 | Korn | 52/592 |
| 2,023,452 | 12/1935 | Voegeli | 52/592 X |
| 2,345,792 | 4/1944 | Cann | 312/214 X |
| 2,416,845 | 3/1947 | Richard | 312/214 |
| 2,701,746 | 2/1955 | Piggott | 312/214 X |
| 2,762,470 | 9/1956 | Parkes et al. | 52/535 X |
| 2,896,271 | 7/1959 | Kloote et al. | 52/309 X |
| 3,311,948 | 4/1967 | Axelsonn | 264/46.5 X |
| 3,332,170 | 7/1967 | Bangs | 52/309 X |
| 3,332,194 | 7/1967 | Jack | 52/592 |
| 3,339,783 | 9/1967 | Gorman | 52/406 X |
| 3,353,863 | 11/1967 | Koot | 312/214 X |
| 3,714,747 | 2/1973 | Curran | 52/309 |
| 3,777,430 | 12/1973 | Tischuk | 52/309 |
| 3,859,401 | 1/1975 | Gallap et al. | 264/46.5 X |

FOREIGN PATENT DOCUMENTS

| | | | |
|---|---|---|---|
| 640,458 | 3/1964 | Belgium | 52/309 |
| 421,077 | 12/1934 | United Kingdom | 52/406 |

*Primary Examiner*—Philip Anderson
*Attorney, Agent, or Firm*—Edwin E. Greigg

[57] ABSTRACT

A method of manufacturing refrigerating units (equipment), such as refrigerating and refrigerated showcases, store fixtures and the like, including forming walls, partitions and/or panels having a layer of plastic foam formed in situ. Standard modular elements are produced, each constituting a portion of a wall, bottom or upper portion of the unit to be constructed. Each element is provided with respective stepwise tiers formed along its two longer edges and along its two shorter edges with respective outwardly extending protuberances formed from the layer of plastic foam. The modular elements are assembled along their longer edges, at least some of the shorter edges also being in contact. Units made by the method are described.

6 Claims, 5 Drawing Figures

18
9
9
29
9
24

METHOD OF MAKING REFRIGERATING UNITS AND THE LIKE AND PRODUCT THEREOF

BACKGROUND OF THE INVENTION

This invention relates to a method of making refrigerating equipment, such as refrigerating and refrigerated showcase and store fixtures, and to equipment constructed by the method. The invention relates more particularly to such a method using plastic foam formed in situ, and to such equipment manufactured by the method.

Refrigerating and refrigerated showcases have different dimensions of depth, height and width. Their walls, partitions and/or panels are often thermally insulated by a plastic foam formed in situ. This insulating foam is usually formed in a mold so that the initial shape of the walls is maintained during the fabrication. Known fabrication techniques for refrigerated and refrigerating equipment frequently employ mass production of certain models and types so as to reduce the number of molds and tools necessary for the production and to increase their productivity. Notably, the units within the same model or type also have the same depth. In practice, in known processes, these units include a lower portion which is made up of a front wall, a bottom and a portion of a rear wall, all assembled in a single unit and insulated by a plastic foam formed in situ and possibly also include an upper portion which defines a ceiling and the remaining fraction of the rear wall and which consists principally of two assembled panels. The edge of one panel and the lateral face of the other panel has a deep groove for holding the ceiling assembly joints. The number of models and types of units which are made in this way is often too limited to satisfy requirements of a large number of locations where the dimensions of the equipment best adapted for their purpose and/or space considerations are very varied.

SUMMARY OF THE INVENTION

It is an object of the present invention to provide a method of making refrigerating and/or refrigerated equipment which avoids the above-mentioned disadvantages, and which does so economically.

It is another object of the present invention to provide a method of making refrigerating and/or refrigerated equipment which is economically sound, while avoiding the above-mentioned disadvantages.

It is an additional object of the present invention to provide a refrigerating or refrigerated unit or fixture which is economical to manufacture and can be easily constructed.

It is a further object of the present invention to provide a refrigerating or refrigerated unit or fixture which can be adjusted easily with respect to its depth and its height.

The foregoing objects are attained according to the present invention, in its method aspect, by fabricating refrigerating or refrigerated equipment made of panels which are thermally insulated by a layer of plastic foam formed in situ. Standard modular elements are produced, each of which constitutes a fraction of one wall, bottom or upper portion of the unit to be constructed and each of which is provided, on the one hand, along its two longer edges with respective stepwise tiers formed in the layer of insulating plastic foam, and on the other hand, at its two shorter edges by respective, outwardly extending protuberances formed from the layer of insulating plastic foam. The method includes assembling these standard modular elements side by side in close contact along their respective longer edges so as to form sealing walls for the units to be constructed.

In its apparatus aspect, the present invention provides a refrigerating or refrigerated unit constructed using the standard modular elements made according to the above-described method.

The present invention can be better understood and further objects and advantages are to become more apparent from the ensuing detailed description of the specification of exemplary embodiments taken in conjunction with the accompanying drawing.

DESCRIPTION OF PREFERRED EMBODIMENTS

Figure 1:
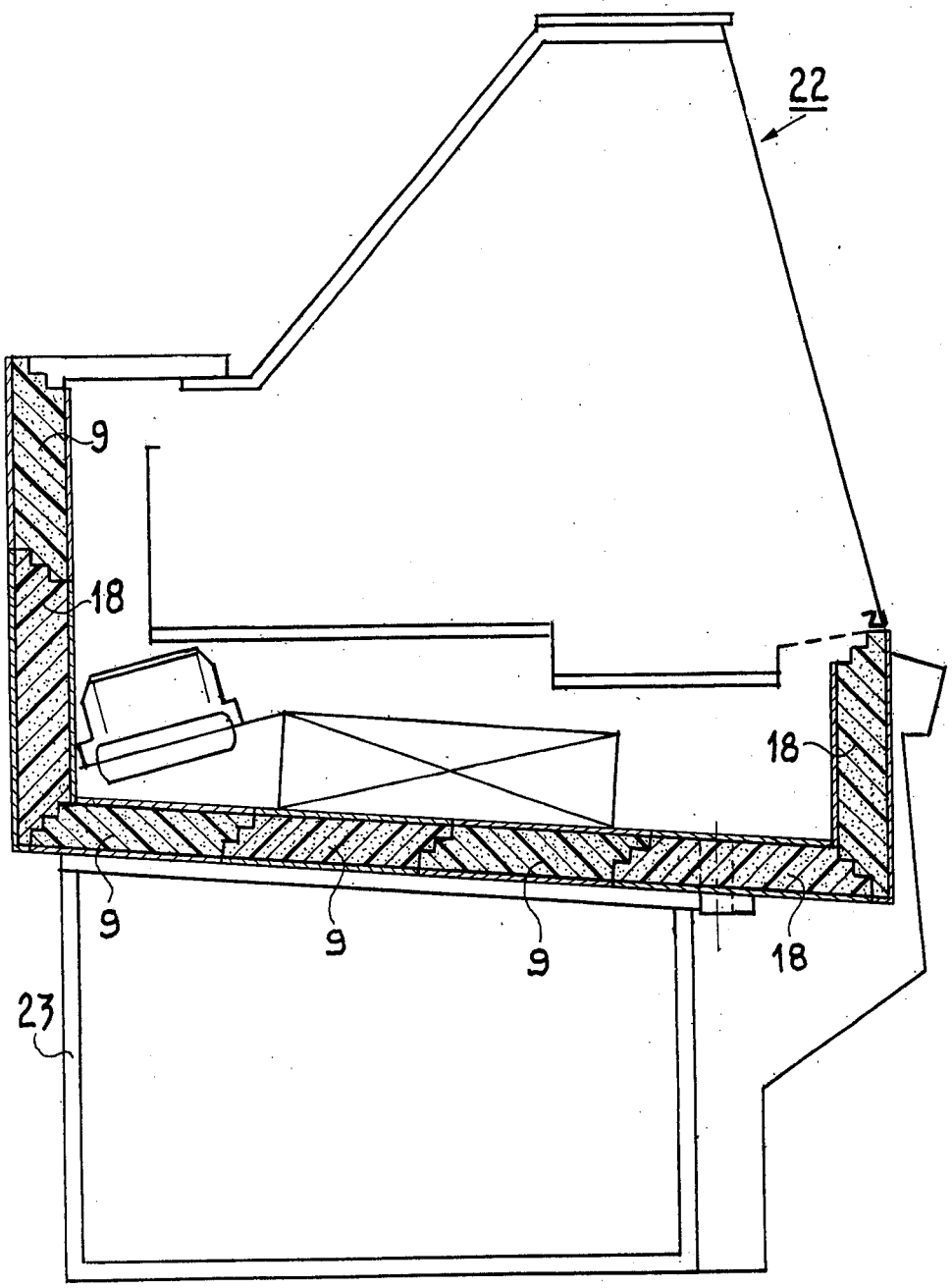
FIG. 1. is a somewhat diagrammatic side view of a refrigerating or refrigerated showcase in transverse section, made according to the method of the present invention.
Figure 2:
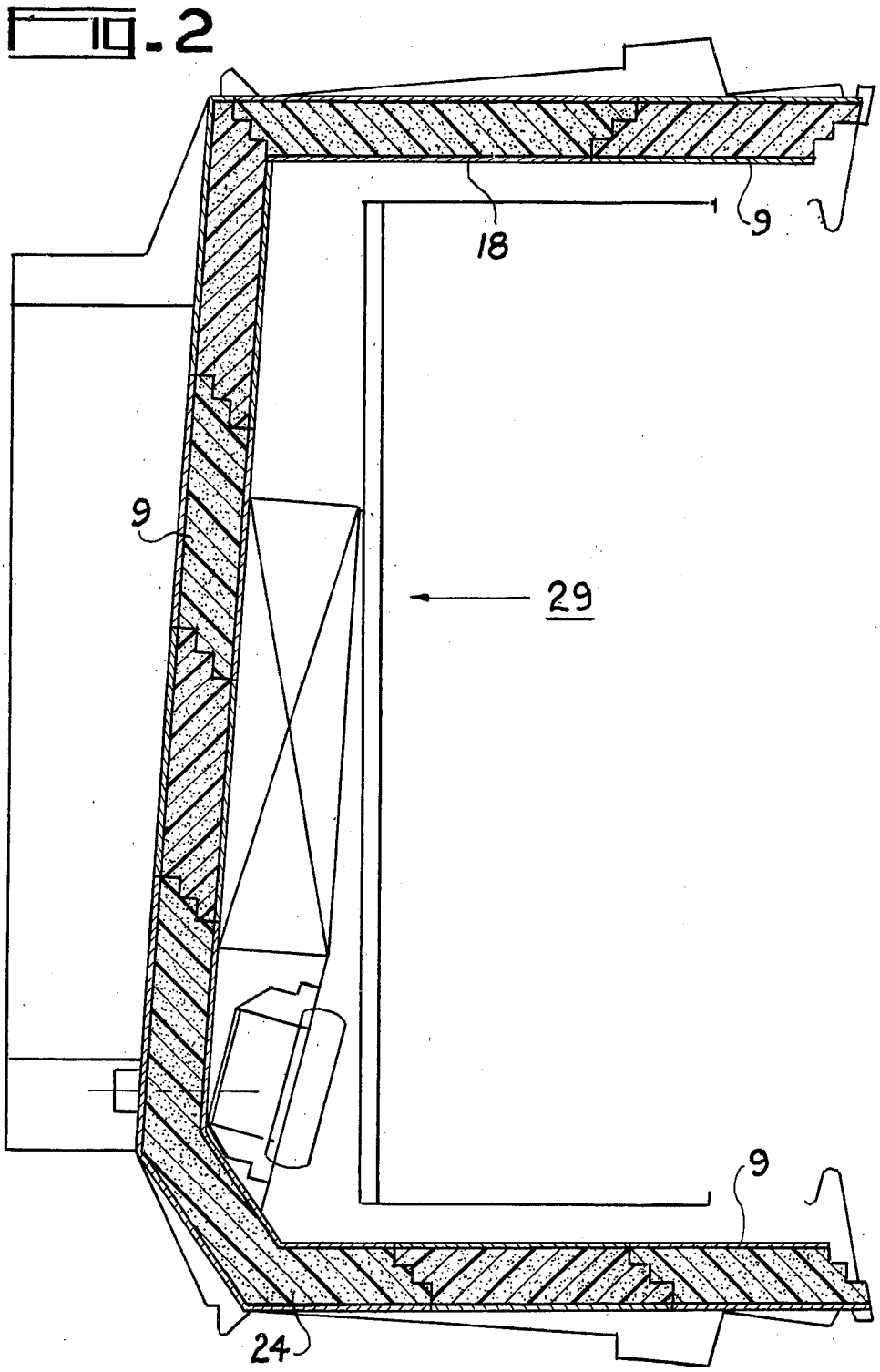
FIG. 2 is a somewhat diagrammatic top view of a refrigerating or refrigerated unit in transverse section, made according to the method of the present invention.
Figure 3:
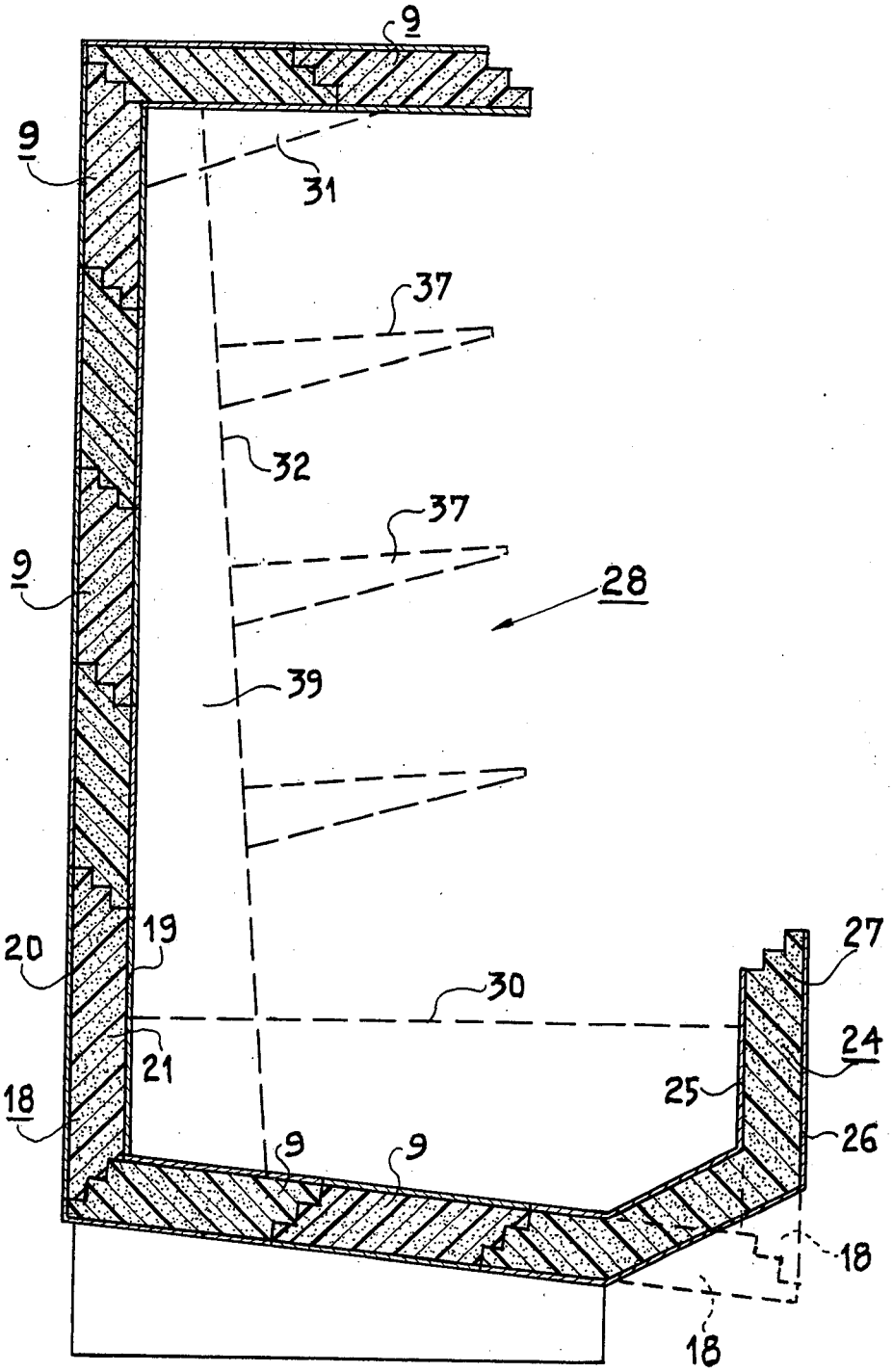
FIG. 3 is a somewhat diagrammatic side view of another version of a refrigerating or refrigerated showcase in transverse section, made according to the present invention.

The invention provides a method according to which refrigerating or refrigerated units, such as showcases and store fixtures are assembled from certain, standard, modular elements which are space-saving, easy to manufacture and stock and each of which constitutes only a small fraction of one of the walls, bottom and upper portion of such units, as can be readily seen in FIGS. 1–3.

Figure 4:
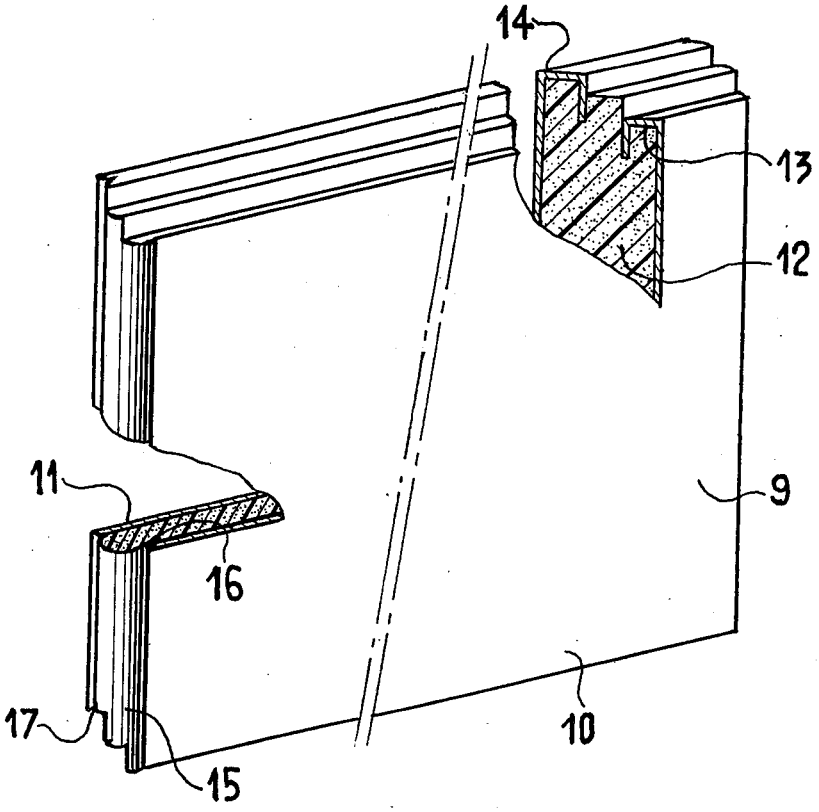
FIG. 4 is a perspective view, in partial section, of one of the basic, standard, modular elements from which the refrigerating or refrigerated showcase of FIG. 3 can be made.
Figure 5:
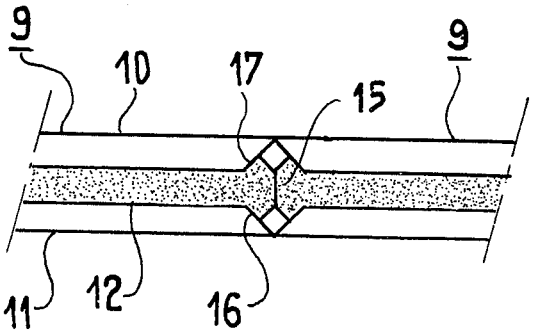
FIG. 5 is a partial view from the top looking down on two standard, modular elements of FIG. 4 mounted side by side in a plane.

The standard, modular elements referred to above, in an exemplary embodiment, are fabricated in two standard, basic models. The first of these basic models is shown as element 9 in FIGS. 1, 2, 3 and is also shown in perspective in FIG. 4. The element 9 has the shape of a rectangular panel which includes two identical metallic wall members 10 and 11 in the shape of troughs (FIG. 4) which face one another and are laterally spaced and separated by a thickness of thermally insulating plastic foam 12 formed in situ. Along the two longer edges of each element 9, the thickness of plastic foam 12 and extending tiers, including tiers 13 and 14 of the wall members 10 and 11 together form respective series of steps. On one of the longer edges, the steps begin at the wall member 10 and end at the wall member 11 and on the other longer edge, the steps begin at the wall member 11 and end on the wall member 10. At each of the shorter edges of the element 9, the thickness of plastic foam forms a respective protuberance 15 which extends outwardly with respect to spaced apart edges 16 and 17 of the wall members 10 and 11. In the element 9, the two tiers 13 and 14 of the metallic wall members 10 and 11 are in the shape of respective troughs preferably make right angles with the flat outer surface of these wall members 10 and 11 whereas the edges 16 and 17 of the wall members 10 and 11 of the two shorter ends make an acute angle with the outer surfaces, as can be seen in FIGS. 4 and 5.

The second of the basic modular elements is designated in FIGS. 1, 2 and 3 by the numeral 18. the element 18 has the form of a rectangular panel, two metallic side wall members 19 and 20 of the same length but different widths, centered with respect to one another and separated by a thickness of thermally insulating, plastic foam 21, formed in situ. Along the two longer edges of the element 18, the thickness of plastic foam 21 and the longer edges of the two wall members 19 and 20 form tiers which begin at the longer wall 20 and end at the shorter wall 19, the long edges being displaced with respect to one another due to the difference in widths of the wall members 19 and 20. In each of the two shorter ends of the element 18, the thickness of the plastic foam 21 forms a central protuberance along its two shorter edges which extends toward the exterior and is analogous to the protuberances 15 extending from the two shorter ends of the modular elements 9.

The stepwise tiers in the two longer edges of each of the modular elements 9 and 18 are of the same shape and dimension such that, when the panels are assembled, the long edges easily adjust and mate to others. The relative elasticity of the stepwise tiers made of plastic foam which are in intimate contact when the various elements are assembled, insures excellent sealing at their points of abutments. When the modular elements 9 and 18 are assembled with their respective ends, in a plane, as shown in FIG. 5, the central protuberances 15 of adjacent modular elements 9 and 18, as the case may be, are compressed against one another and thus assure good sealing along their joints due to their relative elasticity.

A refrigerating or refrigerated unit such as the store fixture or showcase 22 (FIG. 1), is constructed according to the method of the present invention with a number of standard, modular elements 9 and 18 identical to those of the above-described two basic models. In the showcase 22, a front wall is constituted by one standard modular element 18, the bottom wall by another element 18 as well as three standard modular elements 9 and the rear wall consists of one standard, modular element 18 and a standard, modular element 9. These two standard modular elements 9 and 18 are assembled along their respective longer edges and maintained in contact by gussets (not shown) and are mounted on a conventional base 23. The remaining portions of the showcase 22, which are made in a known, conventional manner, are neither described nor shown, because such description is unnecessary to understanding of the present invention.

In a variant embodiment of the present invention, a third basic, modular element is provided. It is constructed so as to be joined to the two basic models 9 and 18 described heretofore. This third constructional element makes it possible to simplify the assembly of refrigerating units constructed according to the present invention in its method aspect. This third constructional modular element is shown in FIGS. 2 and 3 and is indicated by the numeral 24, and can replace the two elements 18 shown in broken lines in the lower right-hand portion of FIG. 3, and is herein designated as the angular modular element 24.

This angular element 24, which has the form of a truncated V, is made in a manner similar to that of the modular elements 9 and 18. The angular, modular element 24 has an inwardly facing metallic panel 25 and an outwardly facing metallic panel 26 which are mutually centered and spaced apart by a layer of thermally insulating plastic foam 27 formed in situ. The panels 25 and 26 have the shape of troughs, as does the panels 10 and 11 and are of the same length but of different widths. The two longer edges of these two panels, therefore, extend and are displaced beyond one another.

In the two longer edges of the angular element 24, the thickness of plastic foam 27 and the extending edges of the panel 25 form stepwise tiers which begin at the inwardly facing panel 25 and end at the outwardly facing panel 26. At each of the ends, the layer of plastic foam 27 forms a central protuberance which extends outwardly and which functions the same and is analogous to the protuberances 15 at the two shorter ends of the standard modular elements 9 and 18. The stepwise tiers in the longer edges of the angular element 24 are identical to those in the longer edges of the standard modular elements 9 and 18. An upright showcase 28, shown in FIG. 3, and a refrigerating or refrigerated unit 29, shown in FIG. 2, are both constructed using a number of modular elements identical to one of the three standard modular elements 9, 18 and 24 described hereabove. Other constructional forms and types of refrigerating or refrigerated units and store fixtures, which are not shown or described, may be constructed using these same standard modular elements. In a refrigerating or refrigerated unit or showcase, the angles of the longitudinal walls are made, according to the techniques of the present invention, either by two standard modular elements 9 and 18 mounted at right angles, or by using a single modular element 24, as shown in FIGS. 2 and 3 by way of example, or by using two modular elements 18, as shown by way of example in FIG. 1.

In the upright showcase 28, as illustrated in FIG. 3, the front portion comprises a single angular element 24, whereas, the bottom panel, the rear panel and the top are made by an assembly of standard modular elements 9 and 18, a portion of the bottom panel being formed by the single, angular element 24. The standard elements 9, 18 and 24 so assembled are maintained in place by conventional gussets 30 and 31 and by profile members which serve as racks formed by upright support members 39, having a face 32 from which shelves 37 extend. The gussets 30 and 31 are mounted at the interior of the showcase 28 and are mounted at the interior of the showcase 28 and are shown diagrammatically by broken lines in FIG. 3, as are the shelves 37, the face 32 and the upright support member 39.

According to the present invention, the modular elements 9, 18 and 24 may have any desired dimensions. If the standard, modular elements respectively have dimensions smaller than those shown in the examples of FIGS. 1, 2, 3, then the extent of the walls of the units as illustrated in the examples would be made with a larger number of these individual modular elements. If the standard modular elements 9, 18 and 24 had greater dimensions than those shown in the examples of FIGS. 1, 2, 3, then the extent of the walls of the units in the illustrated embodiments would be made with a smaller number of these elements.

In order to increase the depth and the height of the unit shown in FIGS. 1–3, the standard modular elements 9, for example, can simply be added within the individual panels of the units.

The depth and height of the units in FIGS. 1-3 could be reduced by simply removing the one or more of the modular elements 9, for example, from these units.

This great facility in changing the dimensions of the refrigerating or refrigerated units made according to the method of the present invention permits the very easy adaptation of these units to virtually any place of installation.

The standard modular elements 9, 18 and 24 take up little space and have a simple construction which is easy to manufacture. Their cost to manufacture is economical. Their small space requirements make them easy to maintain and to stock, for example, in convenient stacks.

Refrigerating or refrigerated units which are fabricated according to the method of the present invention may be mounted end to end if desired so as form an assembly of great length. In that case, the central protuberances 15 of plastic foam at the two shorter ends of the standard modular elements 9, 18 and 24 insure the sealing of the joints of these elements, as shown, for example, in FIG. 5.

The forming in situ of the layers of plastic foam within the modular elements 9, 18, and 24 is carried out by means at a prior art method.

To produce the plastic foam layer 12 within the element 9 of FIG. 4, for instance, a mold is used which is made up from a plurality of plate shaped, rigid, removable (dismountable) elements (not shown in the Figures). These elements can be assembled together to form a tight cavity, whose sole communications with the outside are respectively made up by a first nozzle for injecting the foaming liquid mixture under pressure and a second nozzle for the release of the air present within, before the injection. The cavity (inside) of the mold has an inner form and dimensions identical with the external ones of the element 9. Before the mold is assembled, the two metallic wall members 10 and 11 (FIG. 4) are positioned therewithin along the corresponding inner walls of the mold so as to place them in their respective positions, shown in FIG. 4. After tightly closing (assembling) this mold, the foaming liquid mixture, such as polyurethane, is injected within the mold through the first or inlet nozzle. The polyurethane foam then expands in the free space between the opposite inner surfaces of the metallic wall members 10 and 11 and urges them against the corresponding opposite solid inner walls of the mold. After the foam is solidified, the mold is disassembled and element 9 thus obtained is withdrawn therefrom. The same or similar known methods of foam forming in situ can be used for manufacturing elements 18 and 24.

The foregoing detailed description and accompanying figures of drawing relate to exemplary embodiments of the present invention given by way of example and not by way of limitation. It is to be appreciated that numerous other embodiments and variants are possible within the spirit and scope of the present invention, the scope being defined in the appended claims.

What is claimed is:

1. In a method of manufacturing refrigerating or refrigerated units which are fabricated from lapped standard modular elements, including a layer of thermally insulating plastic foam formed in situ and having multiple step tiers on two opposite edges of each element, each of said elements constituting a fraction of a wall, bottom or upper portion of a unit, the improvement comprising in the production of said standard modular elements, the step of forming along two other opposite edges of each element respective outwardly extending foam plastic protuberances; and a step of assembling a plurality of thus constructed standard modular elements side by side along their edges so as to realize a tight sealing by effecting an intimate contact between said plastic foam stepwise tiers and by compressing said outwardly extending plastic foam protuberances against one another.

2. A method according to claim 1, wherein each element has four edges, and the step of forming the outwardly extending protuberances is affected on each element along its two shorter edges.

3. A method according to claim 1, wherein the producing step includes forming some of said elements in the form of substantially flat panels and forming at least one other in the form of a truncated V.

4. A method according to claim 3, wherein the step of forming at least one other panel in the form of a truncated V includes providing two metal members of a given length and different widths, each having a truncated V profile, aligning these metal members with one another in spaced relationship and forming the layer of thermally insulating plastic foam in situ between these two metal members.

5. A method according to claim 1, wherein the step of producing standard, modular elements produces a plurality of at least a first and a second differently configurated type of basic elements, including the steps of forming each of said first type of basic elements by providing two identical, metal members of a given length, a given width and of trough shape, placing these two trough-shaped members spaced face to face from one another and forming the layer of thermally insulating plastic foam in situ between these metal members, and including the steps of forming each of said second type of basic elements by providing two other metal members of said given length, a width different from said given width and of trough shape, placing these two other trough-shaped members spaced from each other and face to face and forming the layer of thermally insulating plastic foam in situ between these two other metal members, and wherein respective longitudinal edges of said elements form right angles with major surfaces of respective ones of said elements, and respective other edges of said elements make acute angles with these major surfaces of respective ones of said elements.

6. A method according to claim 1, including assembling said elements into a unit using gussets and profiled members by affixing these gussets and profile members within the interior of the unit to serve as supports for products.

* * * * *